US008044985B2

(12) United States Patent
Shen

(10) Patent No.: US 8,044,985 B2
(45) Date of Patent: Oct. 25, 2011

(54) DISPLAY OVERDRIVE METHOD

(75) Inventor: Yuh-Ren Shen, Tainan (TW)

(73) Assignee: Vastview Technology, Inc., Hsinchu (TW)

( * ) Notice: Subject to any disclaimer, the term of this patent is extended or adjusted under 35 U.S.C. 154(b) by 1462 days.

(21) Appl. No.: 11/155,676

(22) Filed: Jun. 20, 2005

(65) Prior Publication Data

US 2006/0284896 A1 Dec. 21, 2006

(51) Int. Cl.
*G09G 5/02* (2006.01)

(52) U.S. Cl. ..... 345/698; 345/89; 348/241

(58) Field of Classification Search ..... 345/87–100, 345/204, 690, 698; 348/169, 222.1, 241, 348/252, 627
See application file for complete search history.

(56) References Cited

U.S. PATENT DOCUMENTS 7,012,591 B2 * 3/2006 Chen et al. ..... 345/88
2002/0126106 A1 * 9/2002 Naito ..... 345/204
2002/0145581 A1 * 10/2002 Kudo et al. ..... 345/89
2002/0163490 A1 * 11/2002 Nose ..... 345/89
2003/0122754 A1 * 7/2003 Bu ..... 345/87
2003/0201962 A1 * 10/2003 Monomohshi ..... 345/89
2005/0110796 A1 * 5/2005 Flowers et al. ..... 345/589
2005/0219270 A1 * 10/2005 De Greef et al. ..... 345/690
2005/0225522 A1 * 10/2005 Wu et al. ..... 345/87
2005/0275646 A1 * 12/2005 Pai et al. ..... 345/204

* cited by examiner

*Primary Examiner* — Kimnhung Nguyen

(74) *Attorney, Agent, or Firm* — Lowe Hauptman Ham & Berner, LLP

(57) ABSTRACT

A display overdrive method applicable to LCD picture process involves having image data containing gray scale presentation range inputted into the display; a corresponding gray scale range being set up based on the time of a frame from the former range to be present on the display; each gray scale code in the former range being corresponded to the that of the latter to drive the display; gamma voltage corresponding to gray scale in the former range being adjusted relatively to those in the latter range for reducing response time of pixels of the display comparatively to the frame time.

9 Claims, 16 Drawing Sheets

DISPLAY OVERDRIVE METHOD

BACKGROUND OF THE INVENTION (a) Field of the Invention

The present invention is related to a display overdrive method applicable to picture process for various types of displays, and more particularly to one that applies mapping to change gray scale range and adjust gamma voltage to reduce response time thus to upgrade picture quality.

(b) Description of the Prior Art

In image process technology, unlike the conventional CRT that works by having electron beam to collide against a screen coated with light emitting material, the luminance display of an LCD takes time to drive liquid crystal molecules to react with voltage (response time) due to the LCD is subject to the inherited nature of the liquid crystal molecule, e.g. sticking coefficient, dialectic constant and elasticity coefficient. Generally, the response time is divided into two parts:

(1) Rising response time ($T_r$): i.e., with the applied voltage, the time raising taken for the luminance of the liquid crystal box of the LCD to change from the level of 10% up to 90%.

(2) Falling response time ($T_f$), i.e., without the applied voltage, the time falling taken for the luminance of the liquid crystal box to change from the level of 90% down to 10%.

Image data transmitted to the display is comprised of multiple frames. When the display rate of the picture is greater than 25 frames per second, the fast changed pictures will become continuous picture to human eyes thus to create visual pictures including dynamic film and TV game animation. Usually, the display rate of the movies or animation is greater than 60 frames per second, meaning each frame time is equal to 1/60 sec.=16.67 ms. When the response time of the LCD is greater than that frame time, ghost or twitching trace appears on the picture to seriously affect viewing quality. Efforts to upgrade technology for reducing LCD response time are generally inputted in the directions, respectively, lowering the sticking coefficient, reducing the liquid crystal box spacing, increasing the dialectic coefficient, and increasing the drive voltage. Wherein, other than increasing the drive voltage, all the remaining directions involve coordination from liquid crystal materials and manufacturing process. For the increased drive voltage technology, it may enter from the method to drive the liquid crystal panel to further improve gray scale response rate without significantly changing the construction of the display panel. This technology is referred as Overdrive (OD) technology; wherein, increased voltage is transmitted from a driver IC to the liquid crystal panel to increase the rising voltage of the liquid crystal for it to engage in faster cycle of rising and falling thus to quickly arrive at the luminance desired to be present by the image data with shortened response time.

SUMMARY OF THE INVENTION

The primary purpose of the present invention is to provide an overdrive method for a display to present clear picture quality without ghost or blur images as found with the prior art by means of having the gray scale presentation range of image data corresponded to a corresponding gray scale range for the code of the latter to drive the display without changing gamma voltage.

Another purpose of the present invention is to provide an overdrive method for a display to accelerate the changes of the pixel luminance by having the gray scale presentation range of image data corresponded to a corresponding gray scale range and adjusting the gamma voltages.

To achieve those aforesaid purposes of the present invention, procedure of the overdrive method for a display of the present invention includes the following steps. First, image data provided with gray scale presentation range are inputted into the display; a corresponding gray scale range containing multiple continuously distributed gray scale codes is set up with the time for a frame from the image data to present on the display as a frame time; each gray scale code within the gray scale presentation range is corresponded to a gray scale code within the range of the corresponding gray scale; gray scale codes within the range of the corresponding gray scale drive the display without changing the corresponding gamma voltage to drive the display; and relatively to the gray scale codes within the range of the corresponding gray scale, the response time of the pixel of the display is shorter than the frame time. Either by increasing the maximal gamma voltage or lowering the minimum gamma voltage to adjust the gamma voltage will achieves the same purpose of improving picture quality.

Another preferred embodiment yet of the present invention involves having the image data to be inputted into the display and the gray scale codes within the gray scale presentation range of the image data are mapped to that within a corresponding gray scale range; in turn, those gray scale codes within the range of the corresponding gray scale are transmitted to an image process module provided with an OD module to overdrive pixels and virtual bit module to upgrade the gray bit. Wherein, the OD module is capable of judging if the image data relate to dynamic or still pictures, and outputting the driven gamma voltage.

DETAILED DESCRIPTION OF THE PREFERRED EMBODIMENTS

Figure 1:
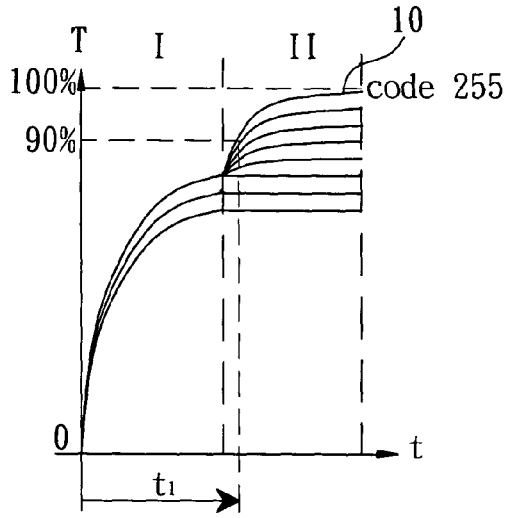
FIG. 1 (PRIOR ART)
FIG. 1 is a schematic view showing a luminance curve of an 8-bit LCD when driven.

Referring to FIG. 1, upon receiving the image data, a liquid crystal display drives the liquid crystal box in the LCD by a gamma voltage corresponding to a gray scale code of the image data for the light beam to create changes in dimness through the luminance of the liquid crystal box. Supposing that the time for the first frame of the image data to display on the display is related to the first frame time I, a curve of its luminance is as illustrated in FIG. 1. Judging from a luminance curve 10 of the maximal gray scale code 255 of an 8-bit LCD, when the luminance for a black picture gradually rises from the start of the first frame time I until the end of the first time frame I and the luminance is not yet arriving at the level as expected, the second phase of changed luminance is immediately followed for a second frame time II. Meanwhile, the curve of luminance produced varies depending on drive voltage applied to the display. If the voltage of the original gray scale code 255 is applied to the display, the curve luminance 10 sees the increased luminance as the time gets longer and 100% luminance for the gray scale code 255 is achieved within the second frame time I. When judged by the definition of a response time of the liquid crystal box, an original response time, $t_1$, taken for the display to reach 90% luminance is longer than the first frame time I to render negative effects of poor picture quality and blur image for the continuous images.

Figure 2:
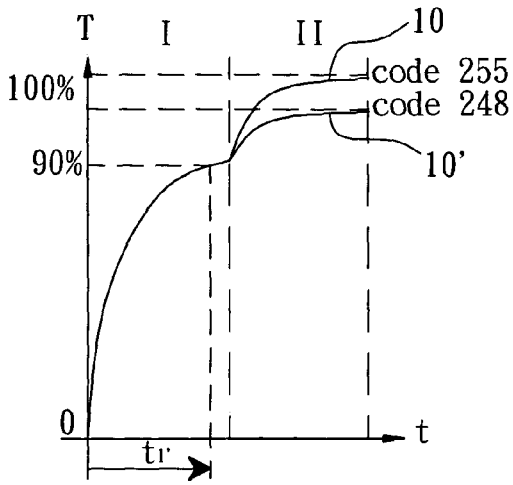
FIG. 2 is a schematic view of a first preferred embodiment of the present invention showing the response time is reduced when the response time from all-black picture to all-bright picture is longer than the frame time.

Referring to FIG. 2, a first preferred embodiment of the present invention of OD method for a display is to input image data provided with gray scale presentation range into the display. Wherein, the gray scale presentation range includes multiple continuously distributed gray scale codes as that happens with a 8-bit display provided with gray scale codes 0~255. A corresponding gray scale range is set up to include also multiple continuously distributed gray scale codes, e.g., 0~248, in relation to those gray scale codes in the corresponding gray scale range. Each gray scale code in the gray scale presentation range corresponds to that in the corresponding gray scale range with the latter applied to drive the display. The correspondence is done by mapping or other proper method without changing the gamma voltage corresponded to the gray scale code within the gray scale presentation range. Taking the gray scale code 255 for example, supposing that the gamma voltage of the gray scale code, e.g. 5V, is sufficient to drive the display from all-black picture to all-bright picture; then after the mapping, the gray scale code 255 is changed to gray scale code 248 without changing the gamma voltage. Therefore, within the first frame time I, a luminance curve 10' of the gray scale code 248 is identical with the luminance curve 10 of the gray scale code 255. However, in relation to the 100% luminance of the gray scale code 248, 90% luminance can be reached within the first frame time I. That is, it adjusted response time $t_1$ will be shorter than the frame time I of the image data and that would not affect the display of the next frame, thus to provide presentation of image with better quality and clarity.

Figure 3:
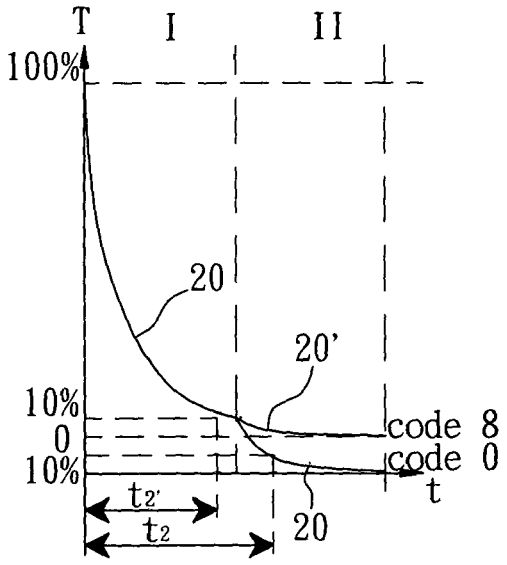
FIG. 3 is another schematic view of the first preferred embodiment of the present invention showing the response time is reduced when the response time from all-bright to all-black pictures is longer than the frame time.

Now referring to FIG. 3, generally a gamma voltage corresponded to the smallest gray scale code 0 is applied to drive the display to convert from all-bright picture to all-black picture. However, if an original response time $t_2$ of the liquid crystal molecule is longer than the frame time, the problem of blur image still presents. Therefore, 0~255 of the gray scale presentation range of the display corresponds to 8~255 of the corresponding gray scale range without changing the gamma voltage set by the gray scale code of the gray scale presentation range. For example, the gamma voltage of the gray scale code 0 drives the display from the all-bright picture to all-black picture and the gray scale code 0 after the mapping is changed to gray scale code 8 without changing the gamma voltage. Therefore, within the first frame time I, a luminance curve 20' of the gray scale code 8 is identical with a luminance curve 20 of the gray scale code 0. However, in relation to the 0% luminance of the gray scale code 8, 10% luminance can be reached within the first frame time I. That is, it adjusted response time $t_2$ will be shorter than the original response time $t_2$, also shorter than the first frame time I of the image data that would not affect the image data display of the next frame, thus to provide presentation of image with better quality and clarity.

Figure 4A:
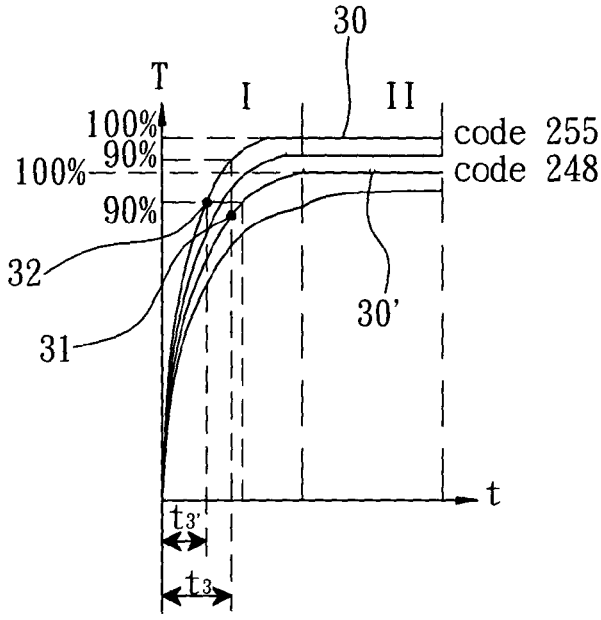
FIG. 4A is a schematic view showing the curve of the luminance with reduced response time when the present invention is applied in a display wherein the original response time from all-bright to all-black pictures is shorter than that of the first frame time.
Figure 4B:
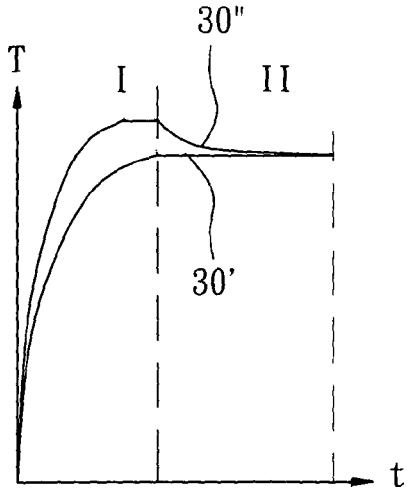
FIG. 4B is a schematic view of a luminance curve showing an overshoot of that illustrated in FIG. 4A.

As illustrated in FIGS. 4A and 4B, should the rising response rate be fast enough so that an original response time $t_3$ taken for the picture to convert form all-black to all-bright is shorter than the first frame time I. That is, the luminance will reach 100% within the first frame time I. The all-bright picture will be displayed with 100% luminance within the second frame time II with its luminance curve marked as 30. By applying the mapping technology, gray scale codes 0~255 of the gray scale presentation range of the image data are mapped in relation to those within the corresponding graph scale range, e.g. gray scale codes 0~248 without changing the gamma voltage corresponded to the gray scale code within the gray scale presentation range. As illustrated by a luminance curve 30' present by the original gray scale code 248, the adjusted response time $t_3$, availed by corresponding its 90% of its luminance to the luminance curve 30 will be shorter than the original response time $t_3$.

Judging from the OD gray code, a gray scale code 31 at the time when the luminance of the luminance curve 30' arrives at 90% within the first frame time I may be deemed as a non-overshoot OD code); however, the gray scale code of the same luminance corresponding to the luminance curve 30 is deemed as an overshoot OD code 32 because that upon entering into the second frame time II, the gray scale code will be adjusted to the luminance displayed by the gray scale code 248 to create the overshoot phenomenon as an luminance curve 30" illustrated in FIG. 4B. However, the overshoot phenomenon appears only momentarily and prevents easy detection by naked eyes.

Figure 5A:
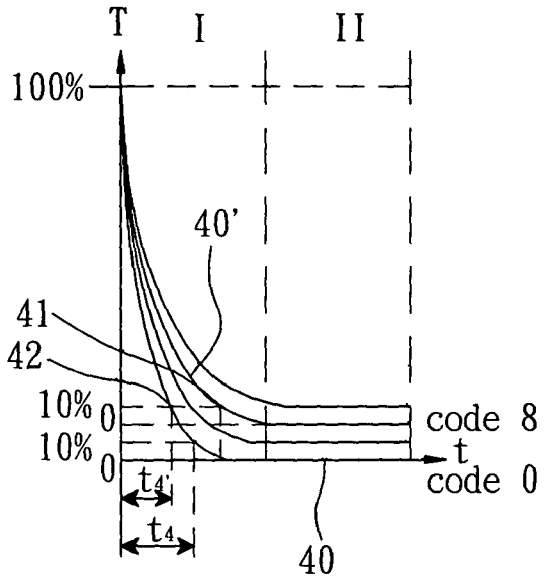
FIG. 5A is a schematic view showing the curve of the luminance with reduced response time when the present invention is applied in a display wherein the original response time from all-black to all-bright pictures is shorter than that of the first frame time.
Figure 5B:
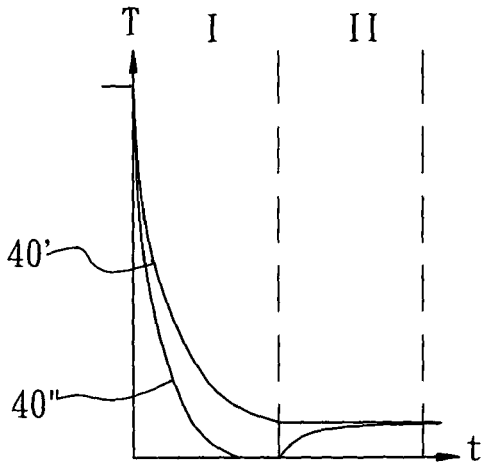
FIG. 5B is a schematic view of a luminance curve showing an overshoot of that illustrated in FIG. 5A.

As illustrated in FIGS. 5A and 5B, if an original response time, $t_4$, taken for the picture to convert from all-bright into all-black is shorter than the first frame time I. That is, the luminance will approach 0% within the first frame time I, and a total black picture of 0% luminance will be displayed within the second frame time with its luminance curve 40 as marked. The gray scale codes 0~255 of the gray scale presentation range of the image data are mapped in relation to those within the corresponding graph scale range, e.g. gray scale codes 0~255 without changing the gamma voltage corresponded to the gray scale code within the gray scale presentation range. As illustrated by a luminance curve 40' present by the original gray scale code 8, the adjusted response time $t_4$ will be shorter than the original response time $t_4$.

Judging from the OD gray code, a gray scale code 41 at the time when the luminance of the luminance curve 40' arrives at 10% within the first frame time I may be deemed as a non-overshoot OD code); however, the gray scale code of the same luminance corresponding to the luminance curve 40 is deemed as an overshoot OD code 42 because that upon entering into the second frame time II, the gray scale code will be adjusted to the luminance displayed by the gray scale code 8 to create the overshoot phenomenon as an luminance curve 40" illustrated in FIG. 5B. However, the overshoot phenomenon will not affect the effects of the presentation.

Figure 6:
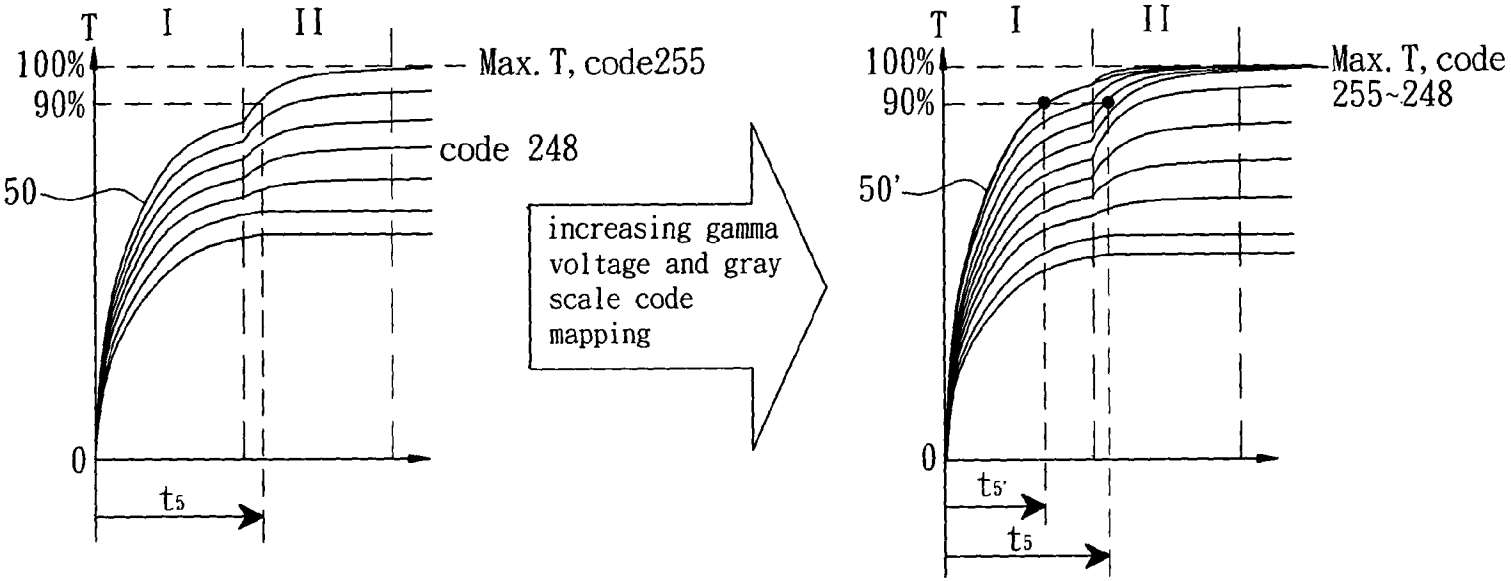
FIG. 6 is a schematic view of a second preferred embodiment of the present invention showing the response time is reduced when the response time from all-black picture to all-bright picture is longer than the frame time.

As illustrated in FIG. 6 for a second preferred embodiment of the present invention for a display overdrive method, the gray scale codes within the gray scale presentation range of the image data are mapped to those within the corresponding gray scale range in relation to that gray scale presentation range while increasing the maximal gamma voltage or decreasing the minimum gamma voltage. Taking an 8-bit display for example, 0~255 of the range of the gray scale presentation are mapped to 0~248 of the corresponding gray scale range. That is, the maximal gamma voltage, e.g. 5V, of the gray scale code 255 drives the display for it to convert from all-black picture to all-bright picture with a luminance curve 50 as illustrated. Wherein, the original response time $t_5$ is longer than the first frame time I. After the mapping, the gray scale code 255 is changed into gray scale code 248 while the gamma voltage is increased up to 5.5V. Accordingly, a luminance curve 50' of the gray scale code 248 will arrive at 90% luminance within the first frame time; that is, its adjusted response time $t_{5'}$ will be shorter than the first frame time I to achieve the purpose of reducing the response time.

Figure 7:
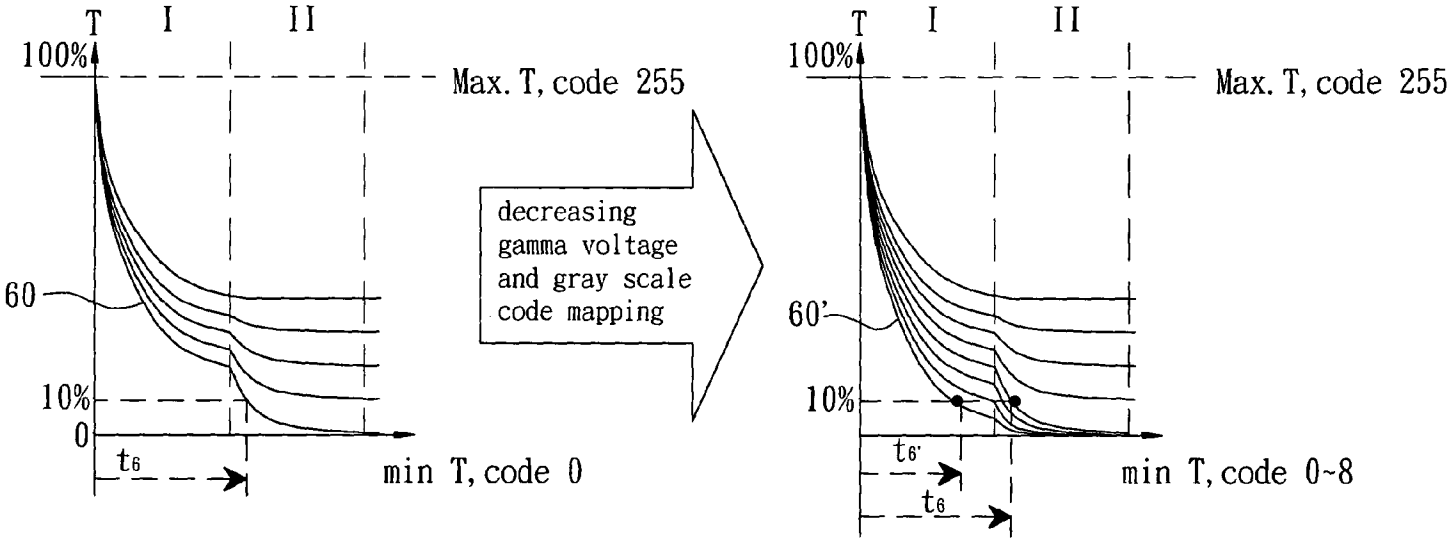
FIG. 7 is another schematic view of the second preferred embodiment of the present invention showing the response time is reduced when the response time from all-bright to all-black pictures is longer than the frame time.

Referring to FIG. 7, the second preferred embodiment of the present invention is further described by taking the switch of all-bright picture to all-black picture as example. Wherein, a minimum gamma voltage of the gray scale code 0 drives the display with 100% luminance to convert it from all-black picture to all-bright picture. Its luminance curve is illustrated as 60 and an original response time t6 is longer than the first frame time I. After the mapping, the gray scale gray scale code 0 is changed into gray scale code 8 with the gamma voltage dropped to 0.1V. Accordingly, as illustrated in a luminance curve 60' of the gray scale code, 10% luminance is achieved within the first frame time I. That is, an adjusted response time $t_6$ is shorter than first frame time I of the image data to achieve the purpose of reducing the response time.

Figure 8:
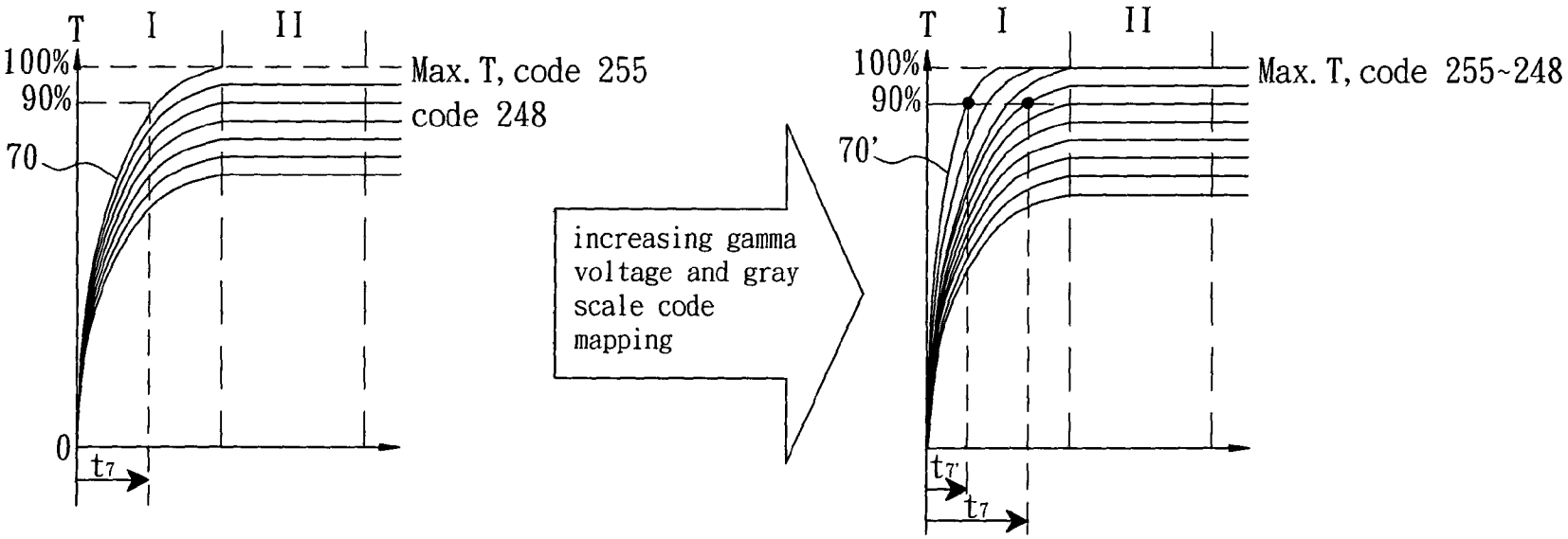
FIG. 8 is a schematic view of a second preferred embodiment of the present invention showing the response time is reduced when the response time from all-black picture to all-bright picture is shorter than the frame time.
Figure 9:
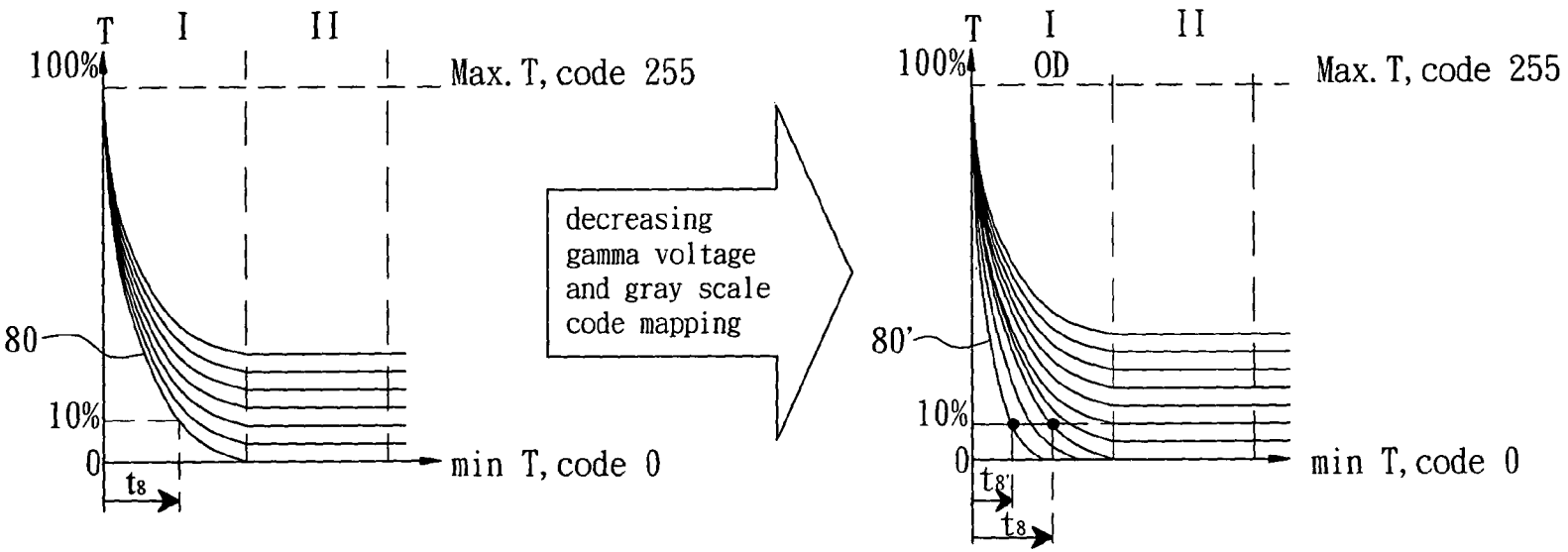
FIG. 9 is another schematic view of the second preferred embodiment of the present invention showing the response time is reduced when the response time from all-bright to all-black pictures is shorter than the frame time.

Similarly as illustrated in FIGS. 8 and 9, if the response times $t_7$, $t_8$ respectively of two luminance curves 70, 80 are shorter than the first frame time I, two luminance curves 70', 80' availed from gray scale mapping and increasing or decreasing the gamma voltage, their adjusted response times $t_{7'}$, $t_{8'}$ will be respectively shorter than their original response times $t_7$, $t_8$.

Figure 10B:
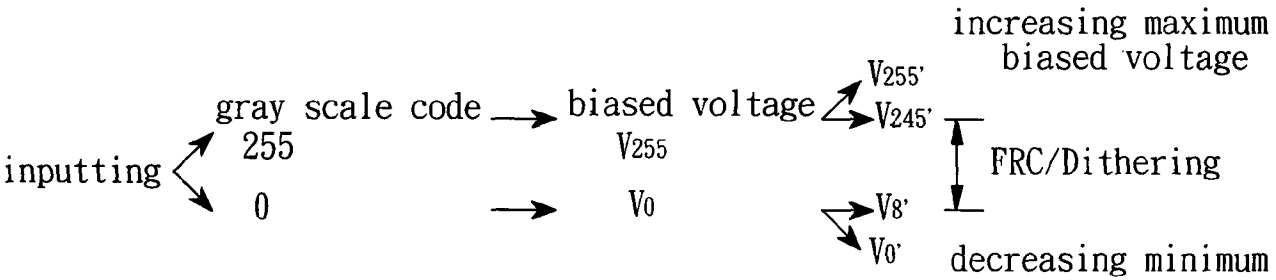
FIG. 10B is a schematic view showing the voltage bias respectively of the maximal gamma voltage and the minimum gamma voltage.
Figure 10C:
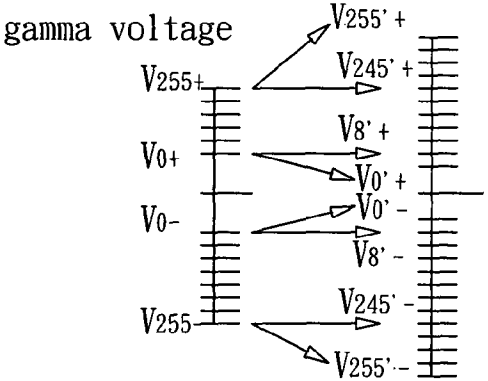
FIG. 10C is a schematic view illustrating ranges of gamma voltage.
Figure 10A:
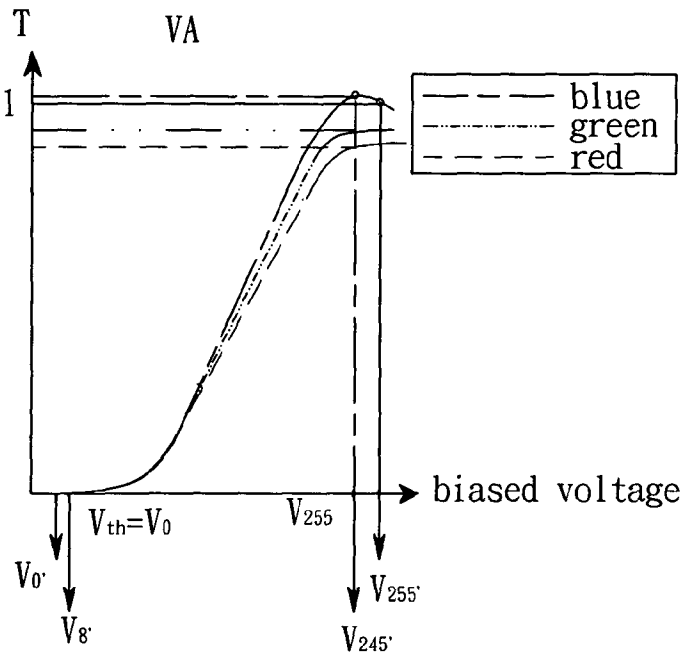
FIG. 10A is a schematic view showing the curve of the changed luminance of each color light.

Taking a VA mode LCD for example, curves of luminance variation respectively for each color light of RGB are illustrated in FIGS. 10A, 10B, and 10C. The picture present when the initial voltage $V_{th}=V_0$ relates to an all-black picture; and the picture present by the gray scale code 255 when applied with a gamma voltage $V_{255}$ relates to an all-bright picture. When the $V_{255}$ is mapped to $V_{245'}$, and $V_0$ to $V_{8'}$, a biased voltage either higher than $V_{245'}$ or lower than $V_{8'}$ will cause the luminance of each color light to change. Wherein, the voltage is increased for greater gray scale code; and decreased, smaller. As illustrated in FIG. 10A, to the blue light within the area of greater scale codes, increasing voltage will cause significant reduction of luminance while change in luminance to the red light or the green light is not significant. Frame Rate Control (FRC) or Dithering technique may be used to avoid loss of gray scale code within the corresponding gray scale range after the mapping. As illustrated in FIG. 10C, when angling from the gamma voltage, the gray scale mapping technique when applied in a general data driver, the preferred embodiment of the present invention can be executed without increasing the knot of the gamma voltage, but a data driver provided with increased gamma voltage knot.

Figure 11A:
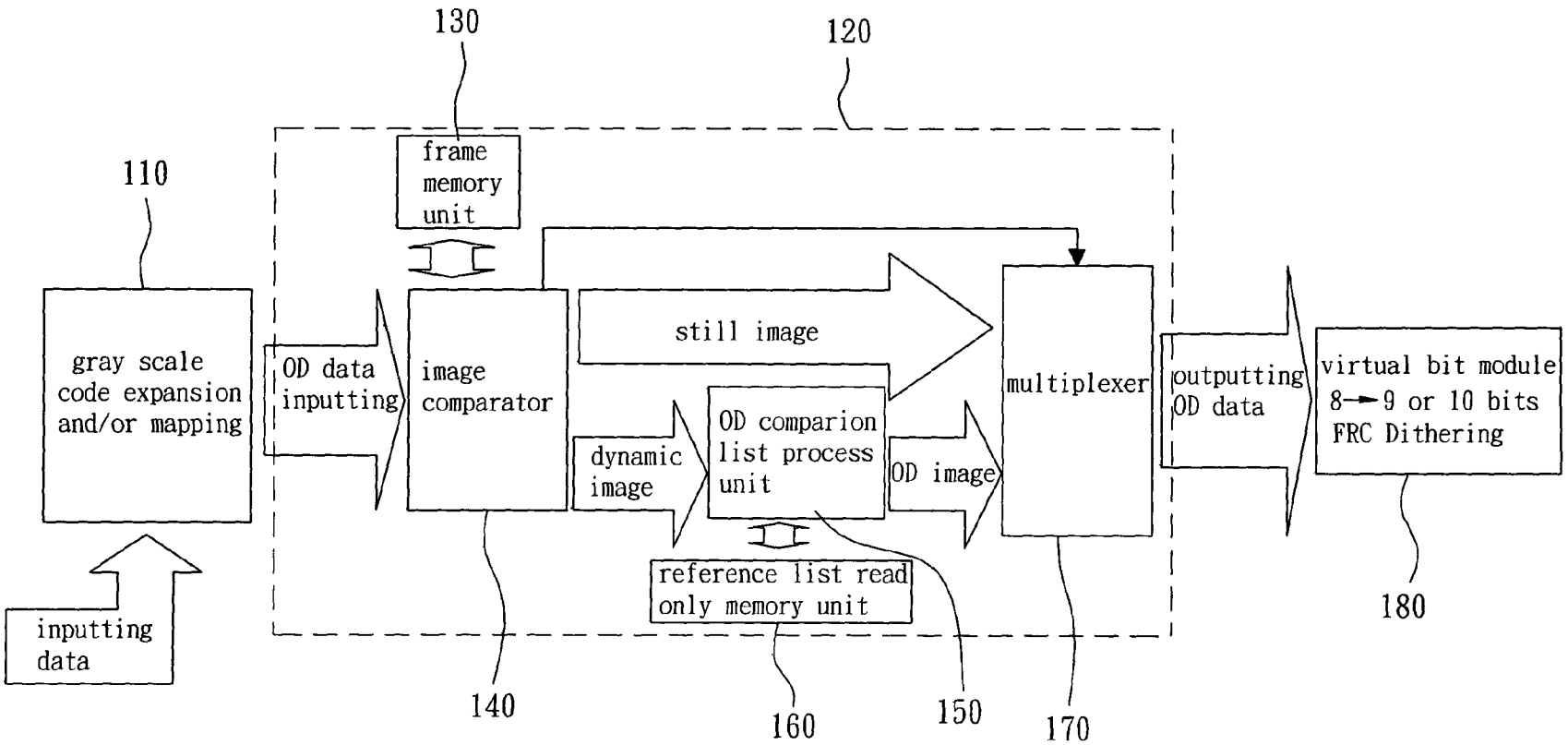
FIG. 11A is a schematic view showing that a third preferred embodiment of the present invention is applied in a scaler.
Figure 11B:
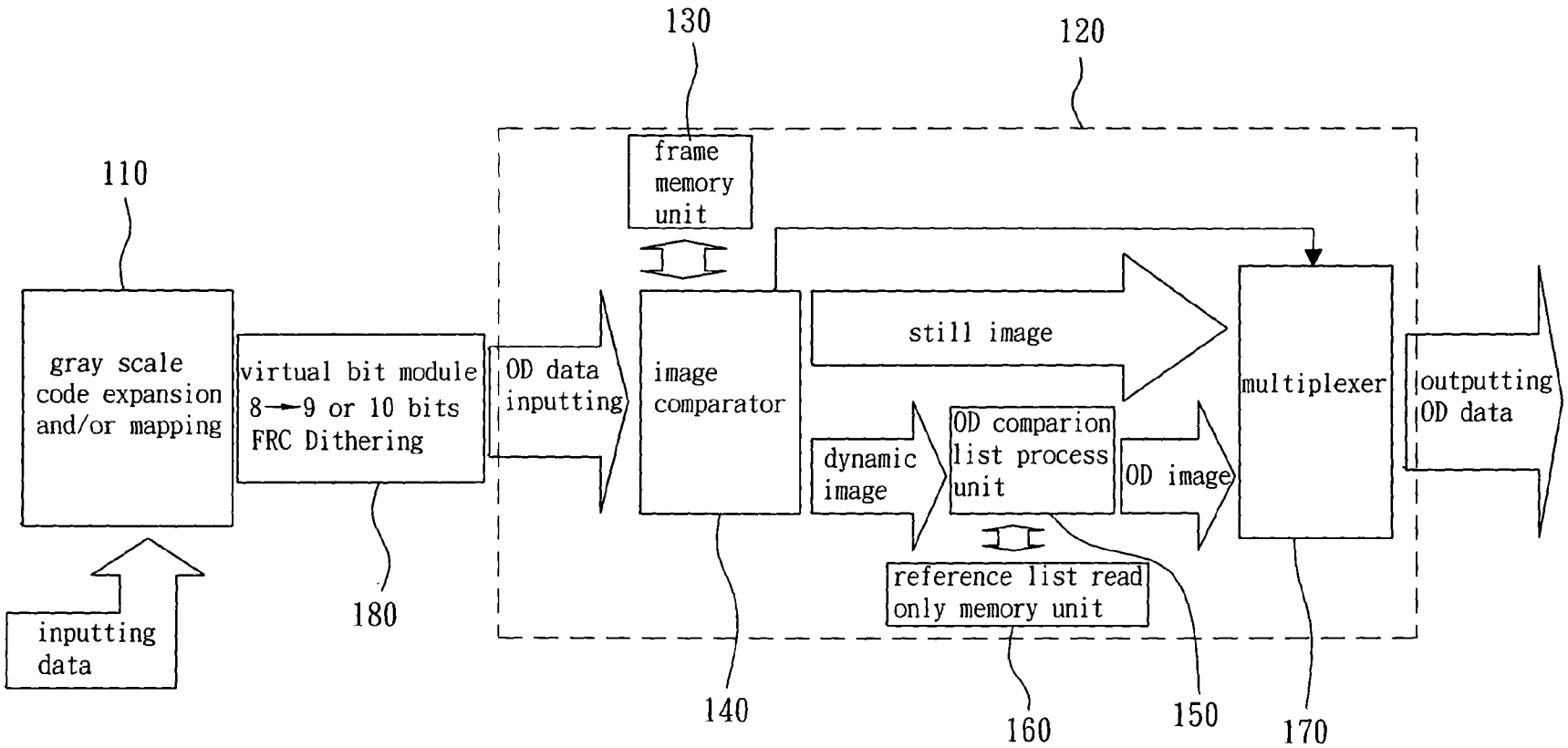
FIG. 11B is a schematic view showing another form for the third preferred embodiment applied in the scaler.

Now referring to FIGS. 11A and 11B for a third preferred embodiment of a display OD method of the present invention when applied in a scaler, a first form of the third preferred embodiment as illustrated in FIG. 11A is comprised of having inputted image data containing gray scale presentation range e.g., a 8-bit gray scale code marked as 110; the gray scale codes within the gray scale presentation range of the image data are mapped to a those in a corresponding gray scale range. For example, 0~512 of the gray scale presentation range are mapped to 0~496; and 0~1024 to 0~992, or the gray scale presentation range is expanded to gray scale codes within an adjusted gray scale range, e.g., having 0~255 of the gray scale presentation range expanded to 512 or 1024 to avoid losing gray scale codes within the gray scale range while the gamma voltage is adjusted as appropriately. For gray scale codes in relation to the corresponding gray scale range of the gray scale range as adjusted, the response time of the display is shorter than the frame time.

Subsequently, those gray scale codes within the corresponding gray scale range or the gray scale range as adjusted are transmitted to a OD module 120 of a pixel OD in the display. The OD module 120 includes a frame memory unit 130 to store the preceding image, an image comparator 140 to compare images, an OD comparison list process unit 150 to process OD numerical values, a comparison list read only memory unit 160 and a multiplexer 170 to pass image data. Wherein, the reference list read only memory unit 160 is related to an ROM. The image comparator 140 reads the preceding image within the frame memory unit 130 to judge if the frame of the image date relates to a still or dynamic picture. If for the former, the picture is sent to the multiplexer 170 to pass the data; if for the latter, the OD reference list process unit 150 reads the gamma voltage corresponded to the gray scale code in the reference list read only memory unit 160 and transmits it to the multiplexer 170 to pass the data and output the overdriven gamma voltage. The most significant bits (MSB) outputted to the multiplexer 170 may be of 8, 9 or 10 bits. Later, the image data are outputted to a virtual bit module 180 to upgrade gray scale bits. The virtual bit module 180 upgrades the gray scale display bit, e.g., 8 bits to 9 or 10 bits, using FRC or Dithering technique.

FIG. 11B shows another form of applying the third preferred embodiment in the scaler. When the inputted image data are gray scale mapped and/or extended, the gray scale display bit is upgraded, e.g., upgrading 8 bits to 9 or 10 bits using the FRC or the Dithering technique through the virtual bit module 180 before being transmitted to the OD module 120 to judge if the image relates to still or dynamic picture and OD processed.

Figure 12A:
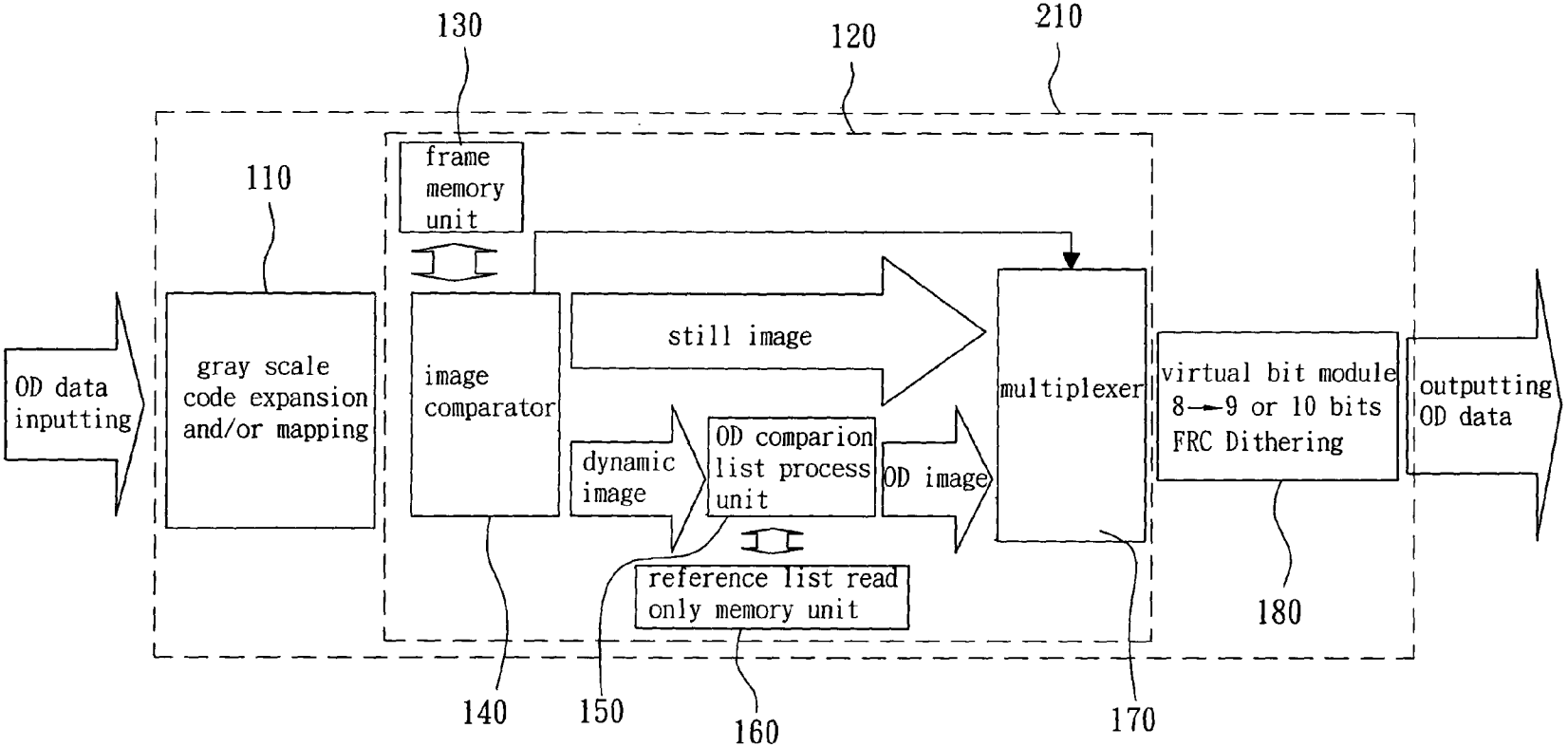
FIG. 12A is a schematic view showing that a fourth preferred embodiment of the present invention applied in a single OD chip.
Figure 12B:
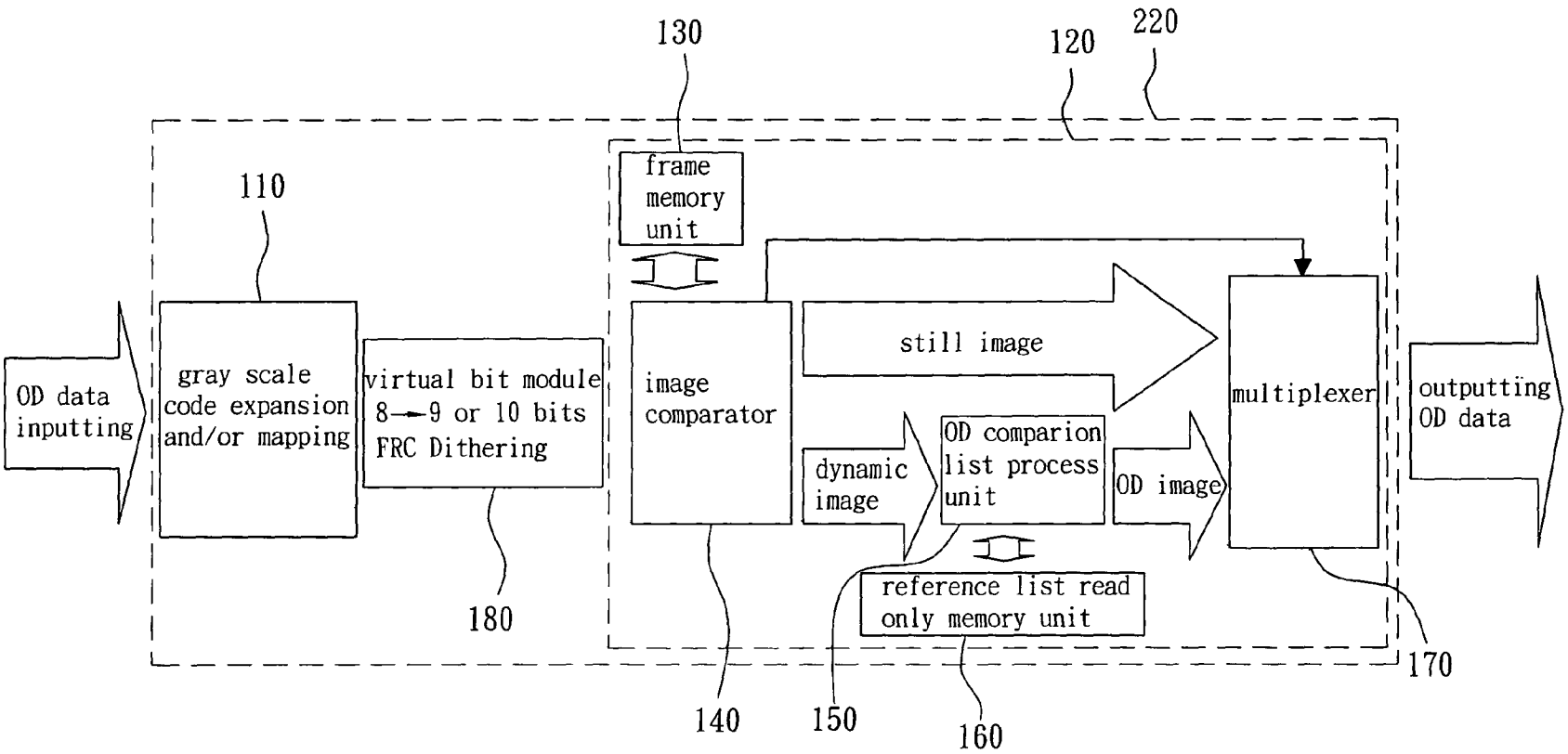
FIG. 12B is a schematic view showing another form for the fourth preferred embodiment of the present invention applied in a single OD chip.

As illustrated in 12A, a fourth preferred embodiment of the present invention applied in an OD single chip includes an image process module 210 to map and/or extend the gray scale codes of the inputted image before having the picture overdriven using the OD module 120, and gray scale display bit upgraded using the virtual bit module 180 to achieve OD purpose as done with the third preferred embodiment. FIG. 12B shows another form of having applied the fourth preferred embodiment of the present invention in an OD single chip. Wherein, what differs an image process module 220 of the fourth preferred embodiment and the image process module 210 of the third preferred embodiment is that with the former the gray scale display bit is first processed by the virtual bit module 180 before being overdriven by the OD module 120.

Figure 13A:
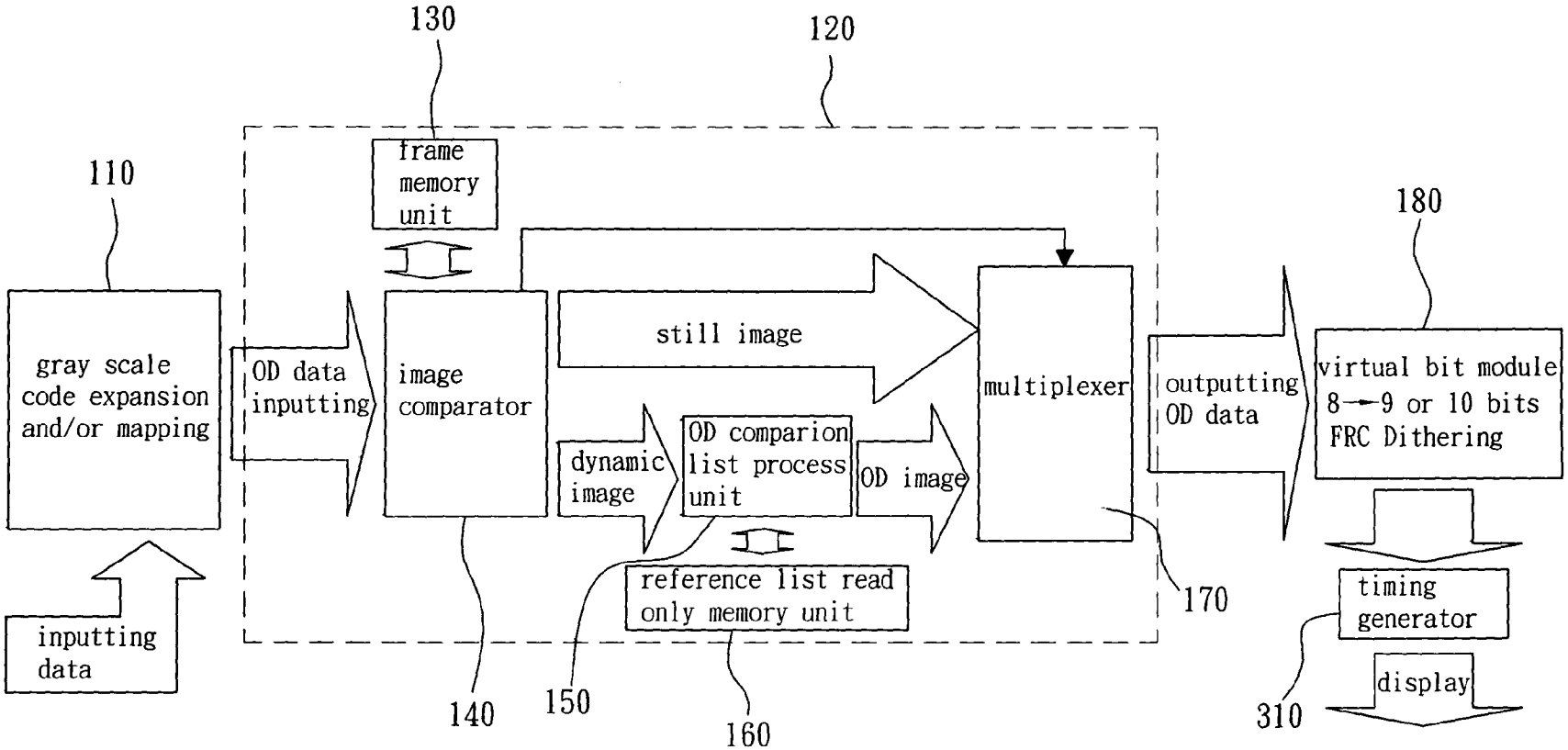
FIG. 13A is a schematic view showing that a fifth preferred embodiment of the present invention is applied in a OD time sequence control module.
Figure 13B:
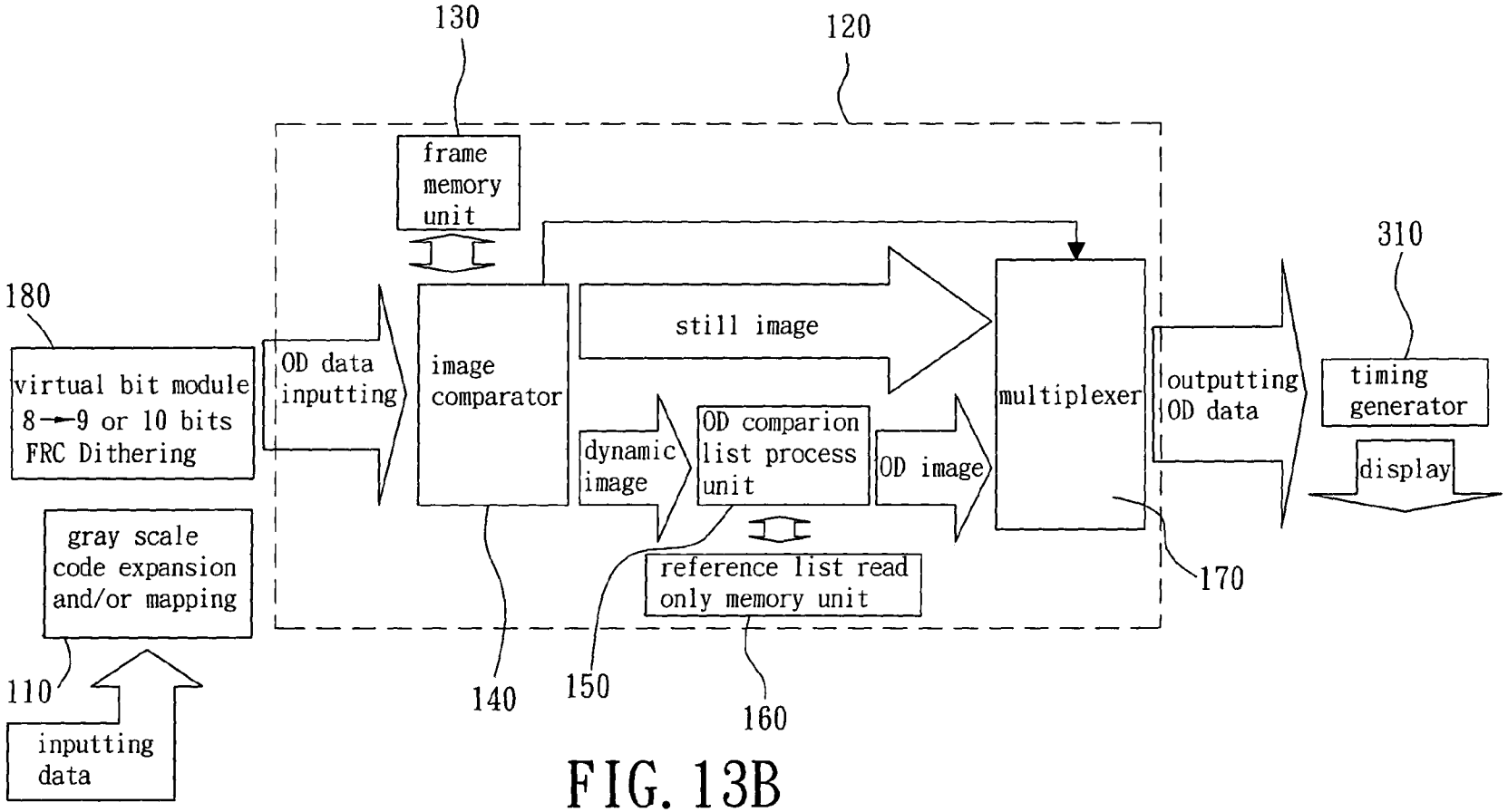
FIG. 13B is a schematic view showing another form for the fifth preferred embodiment of the present invention applied in an OD time sequence control module.

Now referring to FIGS. 13A and 13B for a fifth preferred embodiment of the present invention applied in an OD T-con module, the form and flow are similar to that as illustrated in FIGS. 11A and 11B, but after the final step of the third preferred embodiment, the image before being transmitted to the display is further processed by a Timing generator 310 to control the time sequence of the image. The display applicable to each and all preferred embodiments of the present invention relates to picture process of various types of LCDs.

Figure 14:
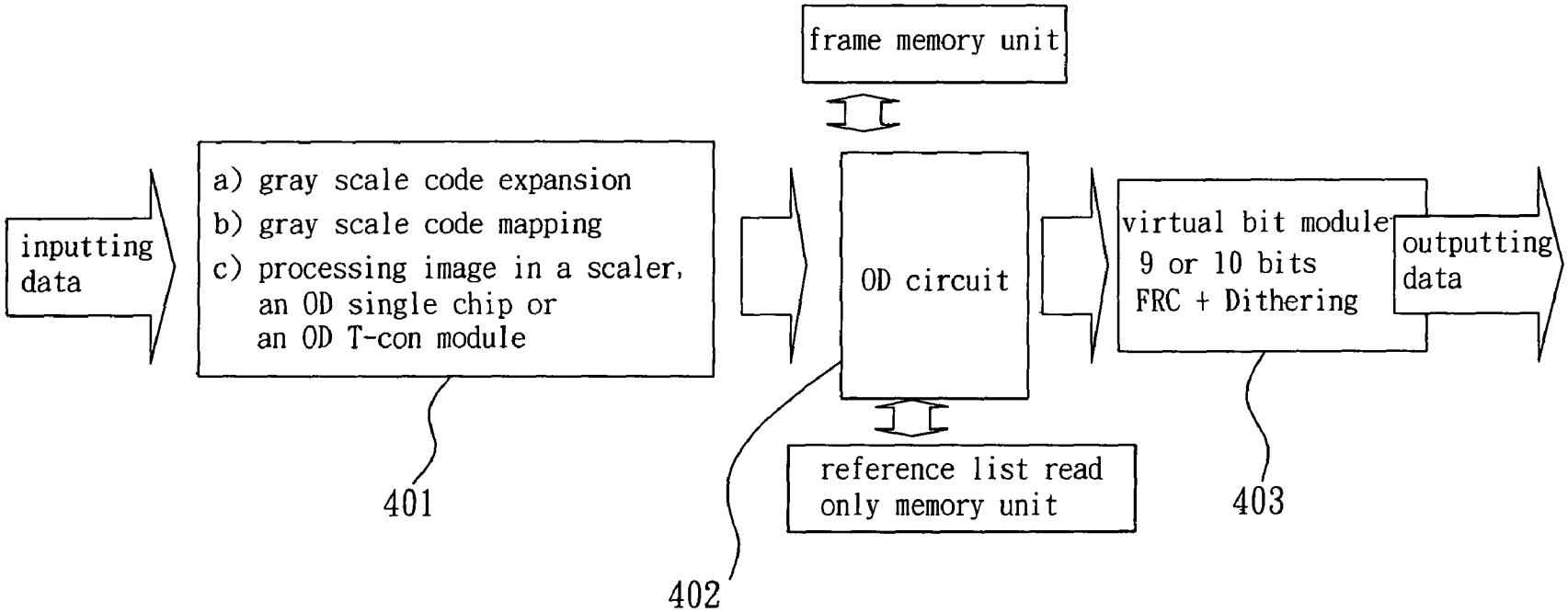
FIG. 14 is a flow chart of the present invention.

Taking the input of 8-bit image for example, the process flow of the present invention may be summarized as illustrated in FIG. 14. Wherein, the inputted image goes through a first step 401 to have the 225 gray scale corresponding to smaller gray scale code using the gray scale mapping method to seek faster response time or have the image data extended to avoid losing gray scale codes of the image, and the image may be processed in a scaler, an OD single chip or an OD T-con module; a second step 402 to compute and process the results from the first step using OD circuit adapted with frame memory unit and reference list read only memory unit; and a third step 403 to be processed using virtual bit module technique, e.g., FRC or Dithering to output the image to the display with better and clearer picture quality than that availed by using the prior art. Wherein, the same results can be achieved by having the third step to take place before the second step.

Methods to relate the gray scale range to the corresponding or adjusted gray scale range as described above are determined depending on customer needs, requirements of picture quality or characteristics of the display and not to limit the claims made in the present invention. Any modification or variation made by anyone who is familiar with this art shall be deemed as falling within the teaching and scope of the present invention.

The prevent invention provides a display overdrive method to reduce response time and improve picture quality, and the application for a patent is duly filed accordingly. However, it is to be noted that that the preferred embodiments disclosed in the specification and the accompanying drawings are not limiting the present invention; and that any construction, installation, or characteristics that is same or similar to that of the present invention should fall within the scope of the purposes and claims of the present invention.

The invention claimed is:

1. The OD method for a display is comprised of the following steps:

having image data provided with gray scale presentation range containing multiple continuously distributed gray scale codes into a display;

a corresponding gray scale range being set up to contain multiple continuously distributed gray scale codes with each gray scale code within the gray scale presentation range being related to that within the corresponding gray scale range;

gray scale codes within the corresponding gray scale range being transmitted to an image process module adapted with an OD module to overdrive pixels in the display and a virtual bit module to upgrade gray scale bit; and the image data being judged as still or dynamite picture and the gamma voltage being overdriven and outputted by the OD module; and wherein the OD module includes a frame memory unit to store the preceding image, an image comparator to compare images, an OD comparison list process unit to process OD numerical values, a comparison list read only memory unit and a multiplexer to pass image data; the image comparator reading the preceding image within the frame memory unit to judge if the frame of the image date relates to a still or dynamic picture; the picture being sent to the multiplexer to pass the data in case of a still picture; and the OD reference list process unit reading the gamma voltage corresponded to the gray scale code in the reference list read only memory unit and transmitting it to the multiplexer to pass the data in case of a dynamic picture.

2. The OD method for a display of claim 1, wherein the corresponding gray scale range is smaller than the gray scale presentation range; and the number of the gray scale code contained in the corresponding gray scale range is smaller than that of the gray scale presentation range.

3. The OD method for a display of claim 1, wherein the gray scale presentation range is extended to an adjusted gray scale range; and the number of the gray scale code contained in the adjusted gray scale range is greater than that of the gray scale presentation range.

4. The OD method for a display of claim 1, wherein the gray scale display bit of the data passing through the multiplexer is upgraded using the frame rate control (FRC) or the Dithering technique through the virtual bit module for the OD module.

5. The OD method for a display of claim 1, wherein the image data inputted to the OD module is first processed to upgrade the bit of the gray scale code within the corresponding gray scale range using the FRC or the Dithering technique.

6. The OD method for a display of claim 1, wherein the method is applied in a scaler.

7. The OD method for a display of claim 1, wherein the method is applied in an OD single chip.

8. The OD method for a display of claim 1, wherein the method is applied in an OD timing controller.

9. The OD method for a display of claim 1, wherein a mapping technique is used to relate the gray scale code to the corresponding gray scale code.

* * * * *